US005177313A

United States Patent [19]

Miyamoto

[11] Patent Number: 5,177,313

[45] Date of Patent: Jan. 5, 1993

[54] RHYTHM PERFORMANCE APPARATUS

[75] Inventor: Hiromu Miyamoto, Hamamatsu, Japan

[73] Assignee: Yamaha Corporation, Hamamatsu, Japan

[21] Appl. No.: 770,561

[22] Filed: Oct. 3, 1991

[30] Foreign Application Priority Data

Oct. 9, 1990 [JP] Japan ..... 2-269645

[51] Int. Cl.[5] ..... G10H 1/40; G10H 7/00

[52] U.S. Cl. ..... 84/611; 84/635; 84/DIG. 12

[58] Field of Search ..... 84/611, 612, 635, 636, 84/DIG. 12

[56] References Cited

U.S. PATENT DOCUMENTS 4,864,908 9/1989 Kino ..... 84/DIG. 12

OTHER PUBLICATIONS

Yamaha Operation Manual of RX8, Aug. 1989.

*Primary Examiner*—Stanley J. Witkowski

*Attorney, Agent, or Firm*—Spensley Horn Jubas & Lubitz

[57] ABSTRACT

A rhythm performance apparatus comprises a memory, ten-key pad or selection switch, drum pads or operation member, and a CPU. The memory has a plurality of rhythm pattern storage areas, including at least one write enable area, for sequentially storing rhythm tones designated by instrument number data and an optional parameter such as a touch data and an instrument localization data in units of tone generation timings. The ten-key pad or selection switch is used for designating a desired storage area and one of the write enable areas. The drum pad and the operation member are used for designating an instrument number and a touch. The CPU copies an optional parameter of the designated instrument number in the designated storage area to the designated write enable area as an optional parameter corresponding to the designated instrument number in the designated write enable area.

8 Claims, 16 Drawing Sheets

| |
|---|
| OP1B |
| OP2B |
| OP3B |
| OP4B |
| OP5B |
FIG. 21
| |
|---|
| PICD |
| DCD |
| PACD |
| FCD |
| BCD |
FIG. 22
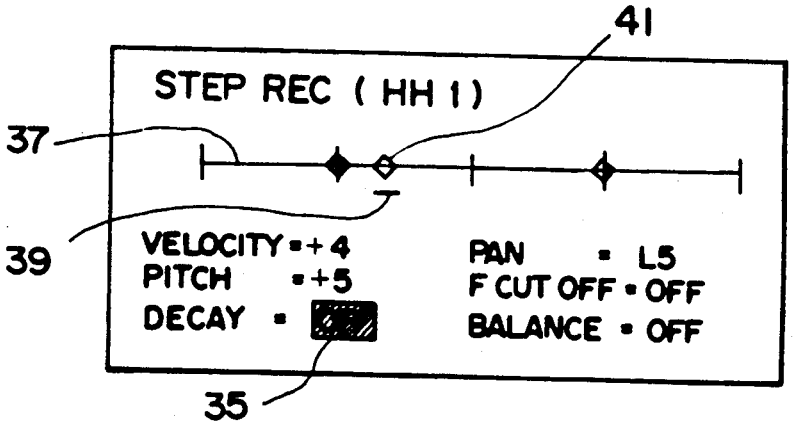
FIG. 23
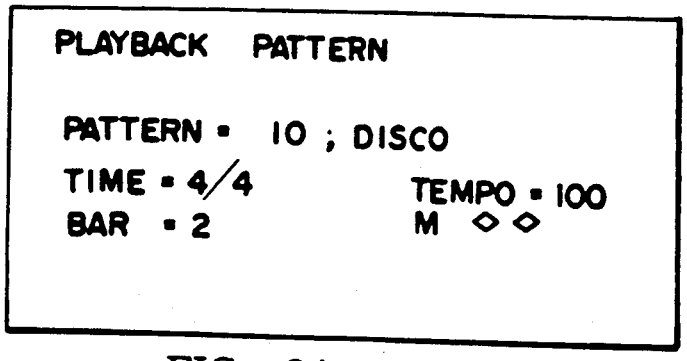
FIG. 24

RHYTHM PERFORMANCE APPARATUS

BACKGROUND OF THE INVENTION

1. Field of the Invention

The present invention relates to a rhythm performance apparatus for making a rhythm performance on the basis of rhythm pattern data stored in a storage means and, more particularly, to a rhythm performance apparatus which facilitates a rhythm pattern edit operation by, e.g., a user.

2. Description of the Related Art

As a conventional rhythm performance apparatus, an apparatus which can set rhythm tones based on instrument types (instrument numbers) and tone generation timings, and can also set a touch (a strength and a tone color), a pitch, a decay curve, localization, and the like of the rhythm tone as an optional function, is known. A rhythm performance apparatus of this type, in which any rhythm pattern can be written by a user, is also known.

However, in the rhythm performance apparatus, when a user edits optional parameters in a rhythm pattern, he or she must input each data value in correspondence with each beat by a so-called step write method. Thus, an operation is not easy.

SUMMARY OF THE INVENTION

The present invention has been made in consideration of the conventional drawbacks, and has as its object to provide a rhythm performance apparatus which can facilitate an edit operation of rhythm pattern data.

In order to achieve the above object, a rhythm performance apparatus of the present invention can read out only a specific optional parameter of a specific instrument number from another rhythm pattern and can copy it as an optional parameter of a rhythm pattern used in a write enable area.

According to the above arrangement, for example, a user need only search a rhythm pattern having "style" similar to a rhythm pattern to be formed, and copy its optional parameter, thus omitting a cumbersome operation for inputting an optional parameter in correspondence with each beat.

BRIEF DESCRIPTION OF THE DRAWINGS

FIG. 21 shows an optional parameter processing buffer allocated on a RAM shown in FIG. 1;

FIG. 22 shows an optical parameter control device table allocated on a ROM or the RAM shown in FIG. 1;

FIGS. 23 and 24 respectively show display screen images on a display shown in FIG. 1.

DETAILED DESCRIPTION OF THE PREFERRED EMBODIMENT

An embodiment of the present invention will be described below with reference to the accompanying drawings.

Figure 1:
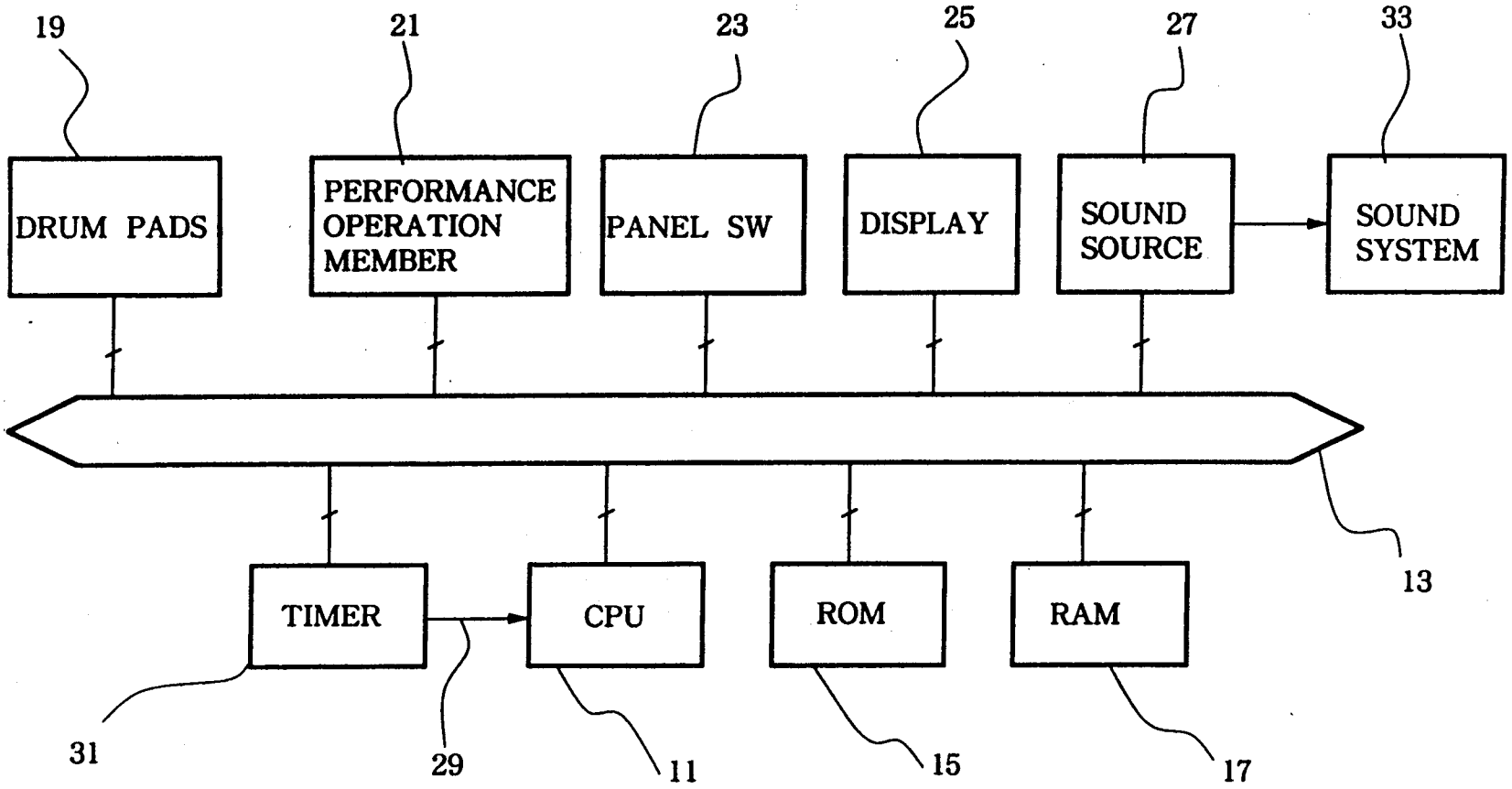
FIG. 1 is a block diagram showing a hardware arrangement of a rhythm performance apparatus according to an embodiment of the present invention.

FIG. 1 shows a hardware arrangement of a rhythm performance apparatus according to an embodiment of the present invention.

The apparatus shown in FIG. 1 controls the overall operation using a central processing unit (CPU) 11. The CPU 11 is connected to a read-only memory (ROM) 15, a random access memory (RAM) 17, drum pads 19, performance operation members 21, a panel switch 23, a display 25, and a sound source 27 via a bidirectional bus line 13. The CPU 11 is also connected to a timer 31 via a signal line 29, and the sound source 27 is connected to a sound system 33.

The ROM 15 stores various control programs such as main routine processing, timer interrupt processing, and the like corresponding to the flow charts shown in FIGS. 2 to 16. The ROM 15 also stores rhythm patterns set by a manufacturer.

The RAM 17 is set with registers, flags, buffers, and the like (to be referred to as registers, and the like hereinafter) for temporarily storing various data generated upon execution of the control programs by the CPU 11, and 16 rhythm pattern storage areas in which rhythm patterns can be written by a user.

Some of the registers, and the like allocated on the RAM 17 will be described below. In the following description, the registers, and the like, and their contents are expressed by the same labels.

Figure 17:
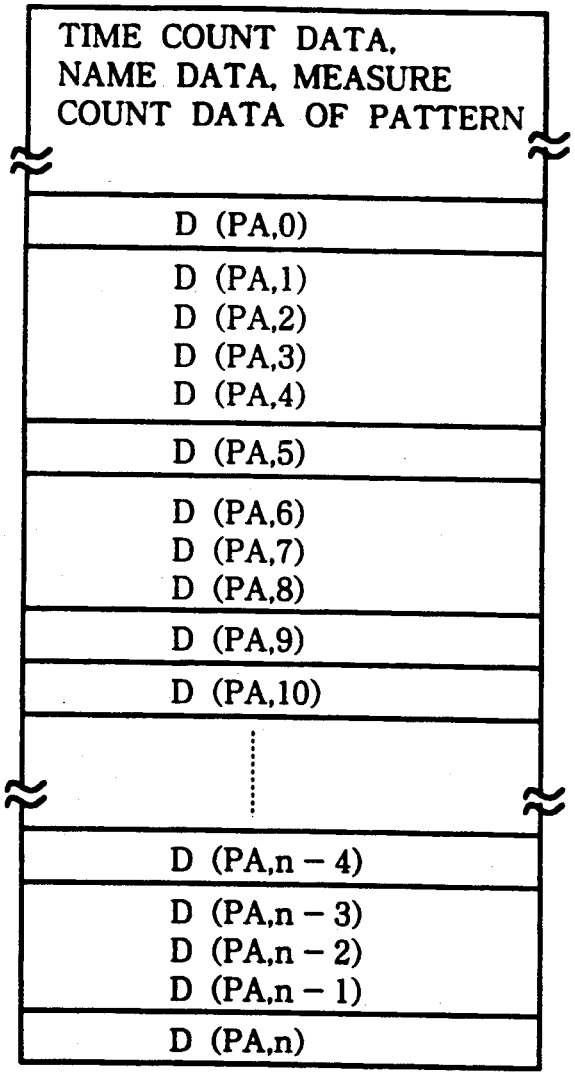
FIG. 17 shows a format of a rhythm pattern recorded in a RAM in the apparatus shown in FIG. 1.

PM: Mode
0: Playback mode
1: Step recording mode
2: Realtime recording mode
3: Pattern playback mode
TIME: Time counter
A counter for counting clocks outputted from the timer 31
SPA: Source pattern start address
A start address of a rhythm pattern storage area as a copy source
KCDS: Source instrument
An instrument number of a copy source pattern
DPA: Destination pattern start address
A start address of a rhythm pattern storage area as a copy destination
KCDD: Destination instrument
An instrument number of a copy destination pattern
SP: Source pattern
A copy source rhythm pattern
BP: Buffer pattern
A rhythm pattern stored in a buffer
BPA: Buffer pattern start address
A start address of the buffer pattern storage area
NS: Source-side interval data register
A register for storing interval register read out from the source pattern
NB: Buffer-side interval data register
A register for storing interval data read out from the buffer pattern
Ps: Source pointer
A source pattern address pointer Pb: Buffer pointer
A buffer pattern address pointer
Pd: Destination pointer
A destination pattern address pointer
PLS: Pattern length
An upper limit of a pattern length, time count x measure count
PAP: Playback pattern start address
Pp: Playback pattern read pointer FIG. 17 shows a format of the rhythm pattern storage area in the ROM 15 and the RAM 17. Several bytes from the start address PA of the rhythm pattern storage area correspond to a header area in which time count data, pattern name data, measure count data, and the like are written. After the header area, a pattern data main body is written in the order of first interval data D(PA, 0), a first group of event data D(PA, 1) to D(PA, 4), second interval data D(PA, 5), a second group of event data D(PA, 6) to D(PA, 8), . . . , the last group of event data D(PA, n−3) to (PA, n−1), and the last interval data D(PA, n).

Figure 18:
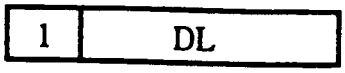
FIG. 18 shows a format of interval data in the rhythm pattern data shown in FIG. 17.

FIG. 18 shows a format of interval data. The interval data is 1-byte (8-bit) data. In this data, as shown in FIG. 18, "1" is set in the most significant bit (MSB) to indicate that this data is the interval data, and interval data indicating an event interval is set in the lower 7 bits as the number of tempo clocks each having a period corresponding to 1/24 a quarter note. More specifically, in this rhythm performance apparatus, one measure in four-four time corresponds to the number of clocks=96. Note that interval data representing a tone generation timing of the last group of event data D(PA, n−3) to (PA, n−1) is D(PA, n−4). The last interval data D(PA, n) is written, so that the pattern length PL calculated based on a time count and a measure count of the pattern is equal to an accumulation value of interval data in the pattern data, and the rhythm pattern can be accurately expressed by repetitive patterns of one or two measures.

Figure 19:
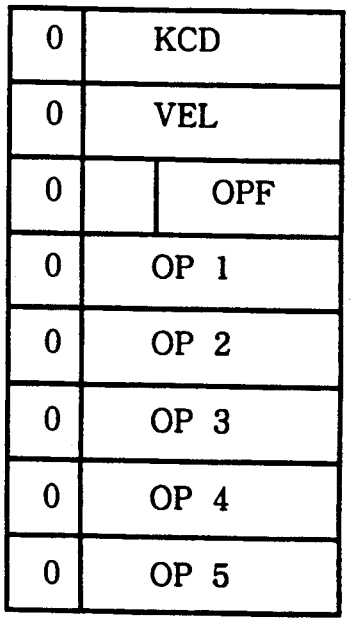
FIG. 19 shows a format of event data in the rhythm pattern data shown in FIG. 17.

FIG. 19 shows a format of event data. One event data is 3- to 8-byte data constituted by 3-byte data consisting of instrument (instrument number) data KCD, velocity data VEL, and an optional parameter flag OPF, and 1-byte optional parameters OP1 to OP5, which are added as needed. If there are a plurality of events having the same timing, a plurality of event data are written for one interval data. For example, in the format shown in FIG. 17, the first group of event data exemplifies a case wherein four events D(PA, 1) to D(PA, 4) simultaneously occur, and the second and last groups of event data exemplify a case wherein three events simultaneously occur. In the MSB of each byte, "0" for identifying event data is written.

Figure 20:
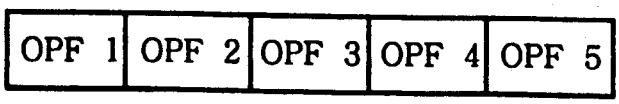
FIG. 20 shows a format of an optional parameter flag in the event data shown in FIG. 19.

FIG. 20 shows in detail the optional parameter flag OPF shown in FIG. 19. The optional parameter flag OPF is 5-bit data, and the bits respectively correspond to the optional parameters OP1 to OP5 in FIG. 19. When event data includes an optional parameter OPx (x=1, 2, . . . , 5), "1" is set in a bit OPFx corresponding to the optional parameter OPx in the flag in FIG. 20. When OPFx="0", an area of the corresponding optional parameter OPx is deleted, and the following areas are rearranged to fill the deleted area.

FIG. 21 shows a buffer for processing the optional parameters OP1 to OP5. In the realtime recording mode, the CPU 11 writes the optional parameters OP1 to OP5 in units of events via this buffer.

In FIG. 1, the plurality of drum pads 19 having relatively large keys are arranged. Each drum pad 19 generates a key code KCD representing an ON pad, and velocity data VEL representing an ON strength in accordance with a key ON operation.

The five performance operation members 21 are arranged in correspondence with the optional parameters OP1 to OP5. As the performance operation members 21, one or two or more types of a wheel, a breath sensor, a lip sensor, a joystick, a foot controller, and a kneel lever may be used.

These performance operation members 21 are used to input optional parameters in the playback (manual performance) mode, and in the realtime recording mode.

FIG. 22 shows an optional parameter control device table showing the correspondence between the performance operation members (control devices) 21 and the optional parameters controlled by these devices. In this table, a pitch control device PICD for controlling a pitch is written in the first byte, and thereafter, a decay control device DCD, a pan control device PACD, a filter control device FCD, and a mixing balance control device BCD are written in the order named. A permanent table set by the manufacturer may be prepared in the ROM. However, the table may be set in the RAM 17, so that it can be changed by a user.

In FIG. 1, the display 25 makes a display according to an operation mode of the rhythm performance apparatus. FIG. 23 shows a display screen image in the step recording mode, and FIG. 24 shows a display screen image in the pattern playback mode.

The panel switch 23 in FIG. 1 includes a playback switch, a recording (REC) switch, a stop (STOP) switch, an optional parameter copy (OPC) switch, cursor switches, arrow switches, and a data slider. The cursor switches are used for vertically and horizontally moving an inverted display position (hatched portion) for indicating an optional parameter to be controlled in FIG. 23 in the step recording mode. The arrow switches are used for horizontally moving a second cursor 39 for indicating, e.g., a tone generation timing in a measure graph 37 in FIG. 23. The data slider is used for inputting optional parameters in the step recording mode.

The sound source 27 forms a musical tone signal on the basis of musical tone control data sent from the CPU 11 in accordance with data read out from the rhythm pattern storage area or a keyboard operation. The musical tone signal is supplied to the sound system 33 including a D/A converter, an amplifier, a loudspeaker, and the like. The sound system 33 converts the musical tone signal into an acoustic wave, and produces it as an actual tone.

The operation of the CPU 11 in the rhythm performance apparatus will be described below with reference to the flow charts shown in FIGS. 2 to 16.

When a power switch (not shown) of the rhythm performance apparatus shown in FIG. 1 is turned on, the CPU 11 starts an operation in accordance with the control program stored in the ROM 15.

Figure 2:
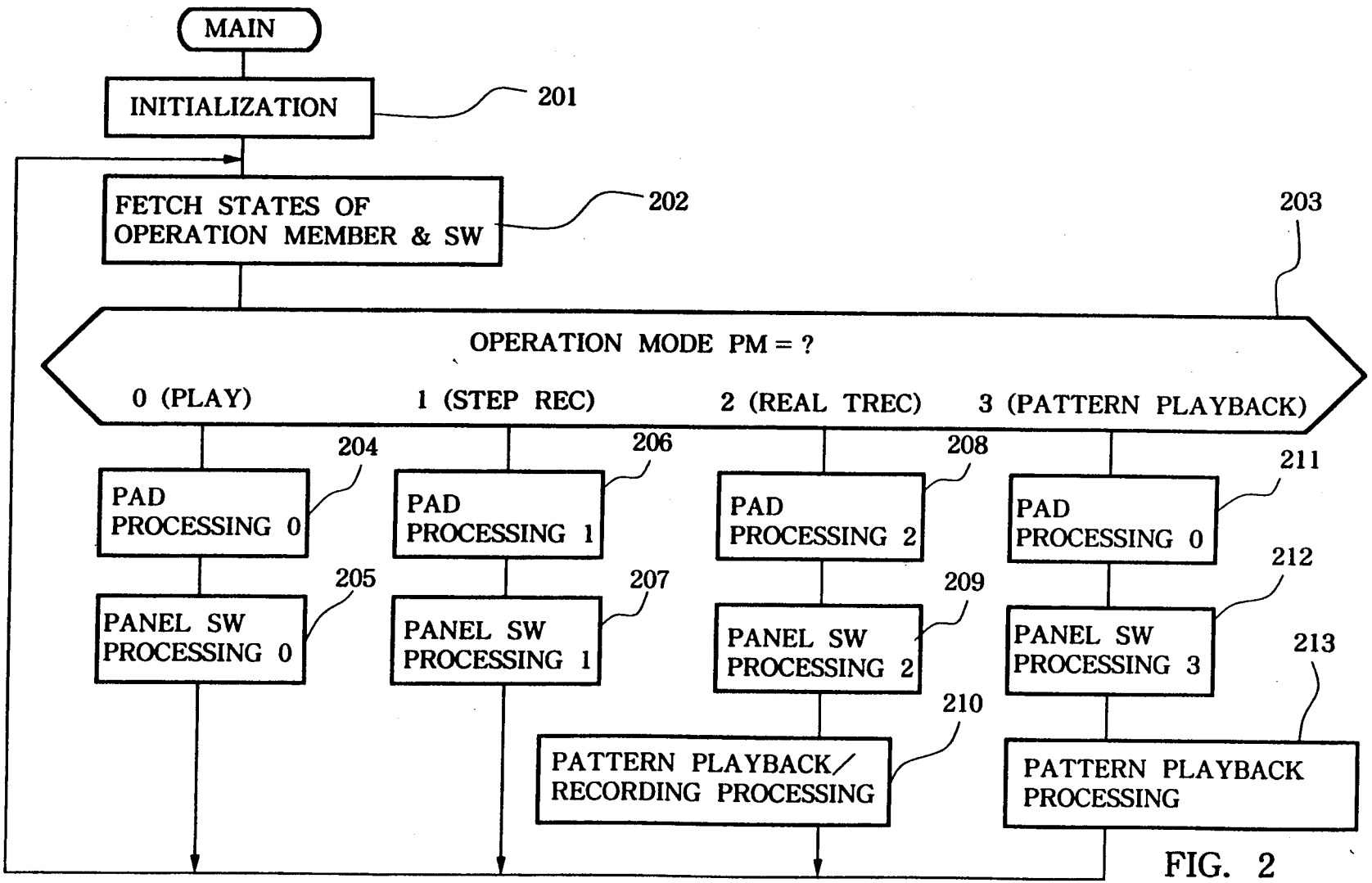
FIGS. 2 to 16 are flow charts showing processing executed by a CPU shown in FIG. 1.

Referring to FIG. 2, in step 201, the CPU 11 executes initialization, e.g., clears the registers, and the like allocated on the RAM 17, and sets predetermined preset values. In step 202, states of the drum pads 19, the operation members 21, and the switch 23 are fetched. Furthermore, in step 203, the mode register PM is checked, and the flow branches to a step according to the mode PM. More specifically, if the content of the register PM, i.e., the current operation mode is a playback mode (PM=0), the flow branches to step 204 to execute pad processing 0 for generating rhythm tones according to operations of the pads 19. In step 205, panel SW processing 0 is executed, and thereafter, the flow returns to step 202. If the step recording mode (PM=1) is selected, the flow branches to step 206 to execute pad processing 1. In step 207, panel SW processing 1 is executed, and thereafter, the flow returns to step 202. If the realtime recording mode (PM=2) is selected, the flow branches to step 208 to execute pad processing 2. Subsequently, panel SW processing 2 is executed in step 209, and pattern playback/recording processing is executed in step 210. Thereafter, the flow returns to step 202. If the pattern playback mode (PM=3) is selected, the flow branches to step 211 to execute the above-mentioned pad processing 0. Furthermore, panel SW processing 3 is executed in step 212, and pattern playback processing is executed in step 213. Thereafter, the flow returns to step 202.

Figure 3:
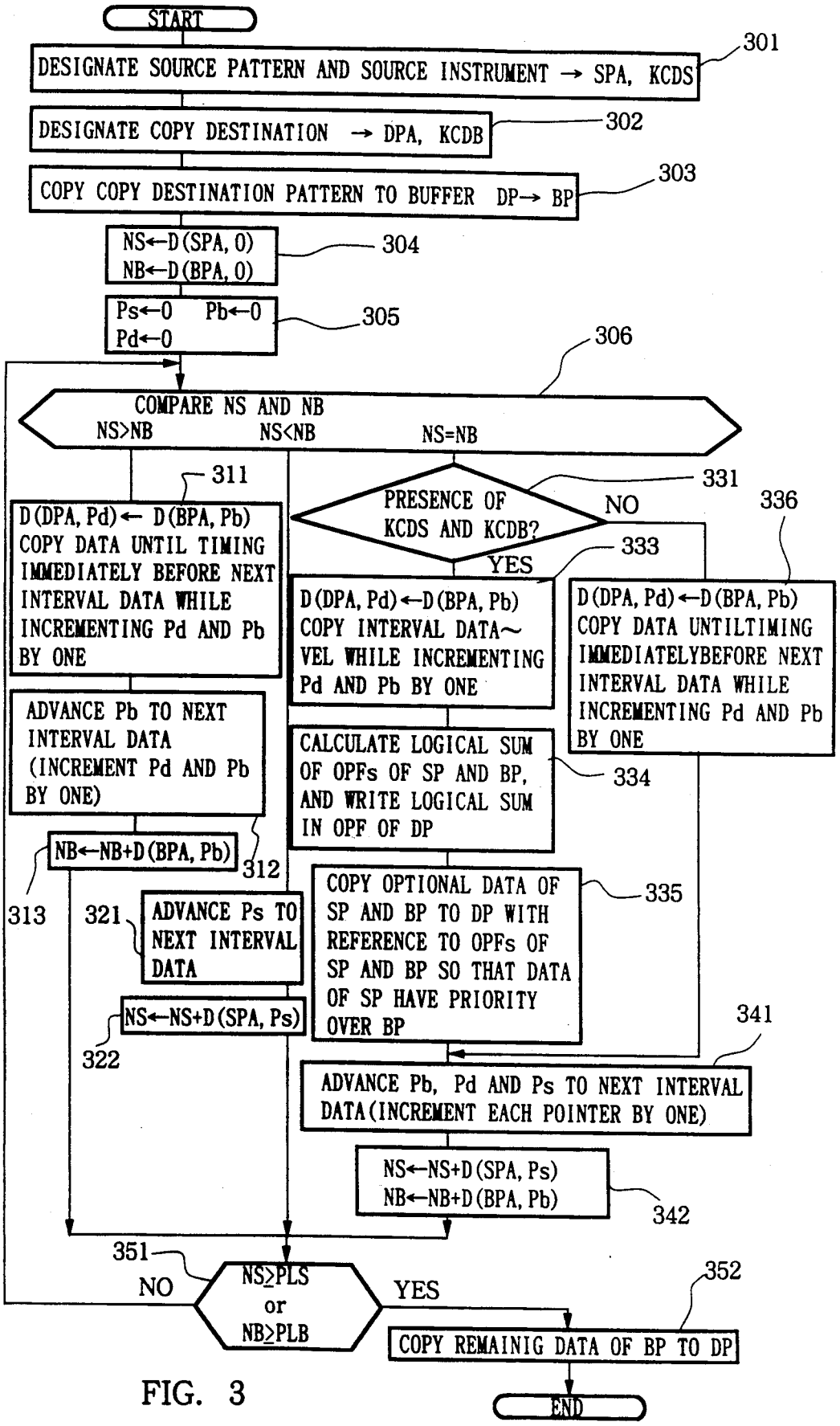

In the rhythm performance apparatus shown in FIG. 1, when the optional parameter copy switch ([OPC] SW) of the panel switches 23 is turned on in the playback mode (PM=0) or the step recording mode (PM=1), the CPU 11 detects this ON event upon execution of the panel SW processing 0 (step 205) or the panel SW processing 1 (step 207) shown in FIG. 2, and executes [OPC] SW ON event routine shown in FIG. 3.

Referring to FIG. 3, in step 301, a source-side (copy source) pattern number and instrument number which are designated using a ten-key pad or a selection switch are read, and a source pattern start address, and a source instrument number are respectively stored in the registers SPA and KCDS. Furthermore, in step 302, a copy destination pattern number and an instrument number are read, and a copy destination pattern start address and a copy destination instrument number are respectively stored in the registers DPA and KCDB. In step 303, the copy destination pattern DP is transferred to the buffer BP. In this embodiment, the copy destination rhythm pattern is destroyed since a rhythm pattern having a larger data length added with the optional parameters is overwritten. Therefore, the pattern DP is saved in the buffer BP. In step 304, interval data D(SPA,0) and D(BPA,0) located at the beginning of the data main bodies of the source pattern SP and the buffer pattern BP are read out, and are respectively stored in the timing registers NS and NB. In step 305, the address pointers Ps, Pb, and Pd for the source pattern SP, the buffer pattern BP, and the copy destination pattern DP are cleared. Thereafter, in step 306, the source-side tone generation timing NS is compared with the buffer-side tone generation timing NB.

If NS>NB, this means that there is no parameter to be copied on the source side at the timing NB. In this case, a buffer-side timing is advanced to the next tone generation timing while restoring buffer-side data to the copy destination. That is, in step 311, interval data (BPA,Pb) of the buffer pattern PB is copied as interval data D (DPA,Pb) of the copy destination DP, and the content of the pattern BP until a timing immediately before the next interval data is copied to the copy destination DP while incrementing the pointers Pb and Pd by one. In step 312, the pointers Pb and Pd are further incremented by one. In step 313, interval data D(PBA,Pb) at the incremented address Pb of the buffer PB is read out, and is added to the tone generation timing NB. Thereafter, the flow advances to step 351.

If NS<NB, this means that there is no event data to which the optional parameter at the timing NS is to be added in the copy destination. In this case, in step 321, the pointer Ps of the copy source is advanced until the next interval data is read out, and readout interval data D(SPA,Ps) is added to the tone generation timing NS in step 322. Thereafter, the flow advances to step 351.

If it is determined in step 306 that "NS=NB", the flow advances to step 331. In step 331, it is checked if key codes KCDS and KCDD are respectively present in the source pattern SP and the buffer pattern BP until a timing immediately before the next interval data. If both the codes KCDS and KCDD are present, interval data D(BPA,Pb) of the buffer pattern BP is copied to the copy destination DP as interval data D(DPA,Pd), and data from data next to the interval data to velocity data VEL of the key code KCDD of the pattern BP are copied to the copy destination DP while incrementing the pointers Pb and Pd by one. Furthermore, in step 334, the optional parameter flags OPF of the source pattern SP and the buffer pattern BP are logically ORed, and the logical sum is written in the copy destination pattern DP as the optional parameter flag OPF. In step 335, the flags OPFx of the source pattern SP and the buffer pattern BP are looked up. Thus, parameters OPx corresponding to flags OPFx set in the source pattern SP are read out from the source pattern SP, and parameters OPx corresponding to only flags OPFx set in the buffer pattern BP are read out from the buffer pattern BP. The readout optional parameters are copied to the copy destination DP. Furthermore, if there are data until a timing immediately before the next interval data in the pattern BP, these data are copied to the copy destination. Thereafter, the flow advances to step 351.

If "NO" in step 331, i.e., if no key code KCDS is present in the source pattern SP, or no key code KCDD is present in the buffer pattern BP, the flow advances from step 331 to step 336. In step 336, interval data D(BPA,Pb) of the buffer pattern BP is copied as interval data (DPA,Pd) of the copy destination DP, and the content of the pattern BP until a timing immediately before the next interval data is copied to the copy destination DP while incrementing the pointers Pb and Pd by one. Thereafter, the flow advances to step 341.

In step 341, the pointers Pb, Pd and Ps are incremented by one, and each pointer Ps is advanced to the next interval data. In step 342, interval data D(SPA,Ps) at the address Ps of the source pattern SP, and interval data D(BPA,Pb) at the address Pb of the buffer pattern BP are read out, and are respectively added to the tone generation timings NS and NB. Thereafter, the flow advances to step 351.

In step 351, the tone generation timings NS and NB of the source pattern SP and the buffer pattern BP are respectively compared with pattern lengths (time count x measure count) PLS and PLB. If the tone generation timing value NS is equal to or larger than the pattern length PLS, all the data of the source pattern SP have been read out. On the other hand, if the tone generation timing value NB is equal to or larger than the pattern length PLB, all the data of the buffer pattern BP have been read out. If either of these cases is established, the flow advances to step 352, and a non-copied remaining portion is copied from the buffer pattern to the copy destination. Thereafter, the [OPC] SW ON event routine is ended, and the control returns to the previous processing (step 205 or 207 in FIG. 2).

On the other hand, if "NO" in step 351, i.e., if pattern reading operations of the source pattern SP and the buffer pattern SP have not been completed yet, the flow returns from step 351 to step 306, and the processing operations in steps 306 to 351 are repeated.

Figure 25A:
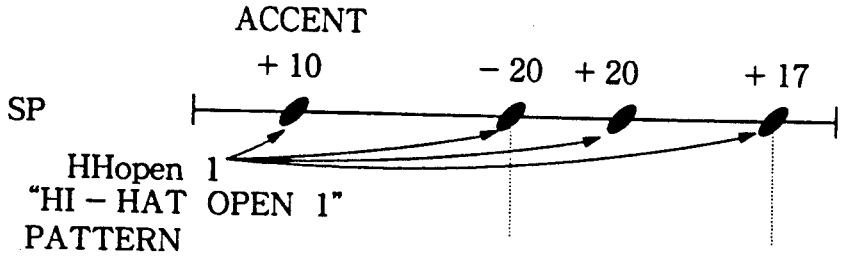
FIGS. 25A, 25B and 25C are explanatory views of optional parameter copy processing in the apparatus shown in FIG. 1.
Figure 25B:
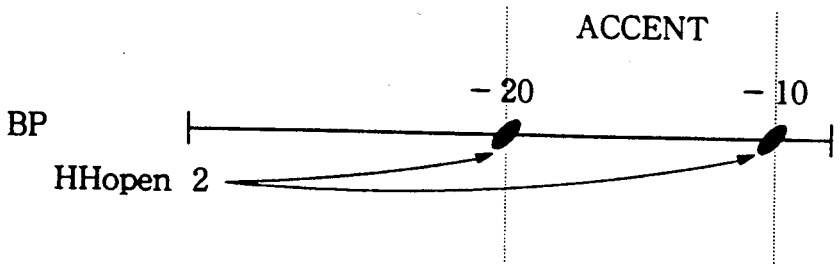
Figure 25C:
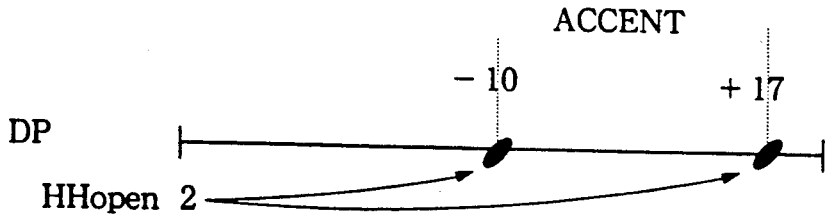

FIGS. 25A to 25C show an optional parameter copy operation state realized by the [OPC] SW ON event routine. FIG. 25A shows the pattern SP as a copy source, FIG. 25B shows the pattern BP as a copy destination, and FIG. 25C shows a pattern DP after execution of the copy operation. When "hi-hat open 1" optional parameters shown in FIG. 25A are to be copied to the "hi-hat open 2" pattern BP shown in FIG. 25B, event timings (black dots) are left unchanged, and only parameters such as accent parameters added to events are changed, as shown in FIG. 25C. In this case, as shown in steps 333 to 342, only optional parameters which are not present in the copy destination but are present in the copy source, or optional parameters which are present in both the copy source and the copy destination but have different contents are added, or rewritten.

In the above description, optional parameters are copied only when event timings of the copy source and the copy destination perfectly coincide with each other. However, when there is no copy source event coinciding with a copy destination event, a copy source event at that timing may be synthesized by interpolation using copy source events before and after that timing, and a copy operation may be performed using the synthesized event.

The copy operation may also be performed regarding as events of the same timing even if the event timings do not perfectly coincide with each other, that is, they are somewhat deviated from each other. Further, although all the kinds of optional parameters of the copy source are copied, any one kind of these optional parameters is designated and the designated kind of the parameters may be copied alone.

Figure 4:
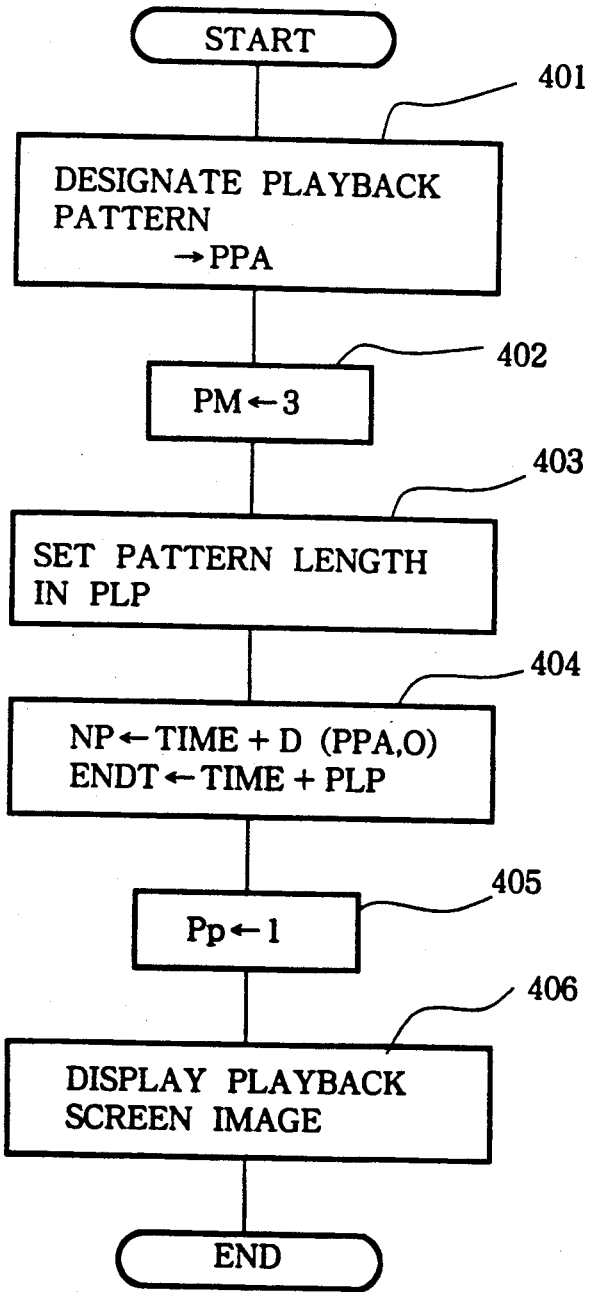

When the playback switch in the panel switch 23 is turned on in the playback mode (PM=0), the CPU 11 detects this ON event upon execution of the panel SW processing 0 in step 205 in FIG. 2, and then executes playback SW ON event processing shown in FIG. 4.

Referring to FIG. 4, in step 401, a number of a playback pattern designated using the ten-key pad or selection switch is read, and its start address is stored in a register PPA. In step 402, the mode register PM is set to be "3" representing the pattern playback mode. In step 403, time count data and measure count data are read out from the header area of the playback pattern starting from the address PPA, and (time count x measure count) is calculated. The calculation result is set in a pattern length register PLP. In step 404, interval data D(PPA,0) written at the beginning (address Pp=0) of the data main body of the playback pattern PP is read out, and is stored in a timing register NP. In addition, the count value of the timer counter TIME is read out, and the sum of the readout count value and the pattern length PLP is stored in a repetition timing register ENDT. Furthermore, in step 405, the address pointer Pp for the playback pattern PP is set to be "1" representing the address of the first event data of the playback pattern. In step 406, the display 25 displays a playback screen image shown in FIG. 24. Thereafter, the playback SW ON event routine is ended, and the flow returns to the previous processing (step 205 in FIG. 2).

Figure 5:
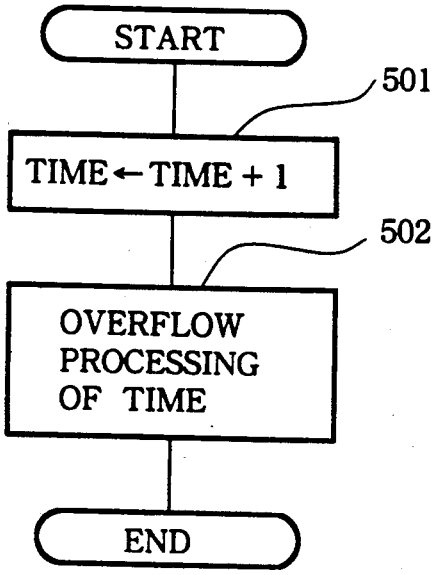

FIG. 5 shows timer counter count processing executed by the CPU 11 using a clock having a period 1/24 a quarter note and outputted from the timer 31 shown in FIG. 1. Referring to FIG. 5, in step 501, the timer counter TIME is incremented. In step 502, overflow processing for, when the counter timer TIME overflows, resetting the counter to its initial value is executed. The timer counter TIME is used in, e.g., step 404 in FIG. 4.

Figure 6:
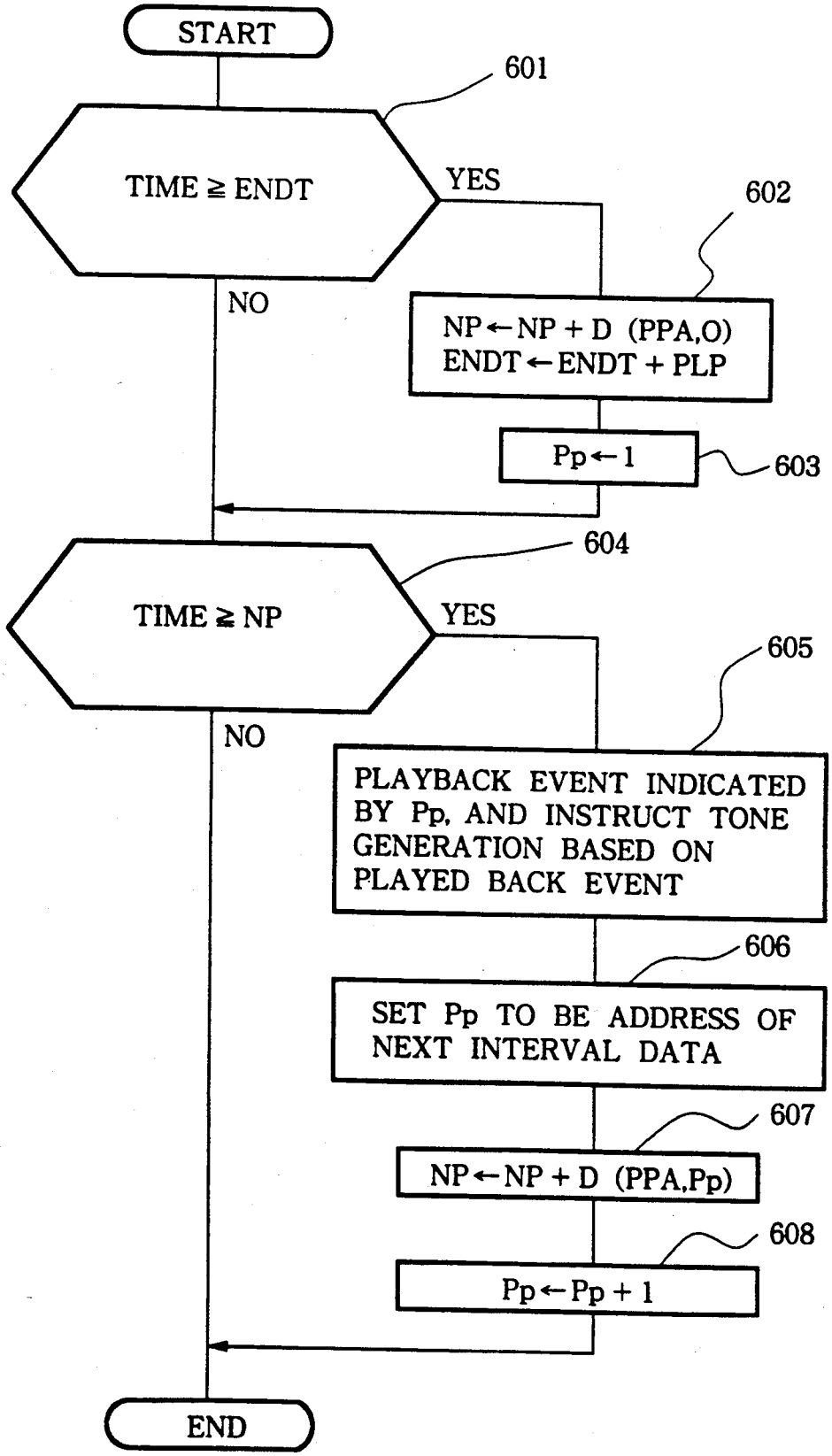

FIG. 6 shows in detail pattern playback processing executed in step 213 in FIG. 2 after the operation mode PM is changed to the pattern playback mode (PM=3) in step 402.

Referring to FIG. 6, in step 601, the count value TIME of the timer counter is compared with the repetition period ENDT (see step 404 in FIG. 4). If the count value TIME is equal to or larger than the period ENDT, since this means that one playback operation of the pattern PP is ended, the flow advances to step 602 to repeat the playback operation of the pattern PP. In step 602, interval data D(PPA,0) at the beginning of the data main body of the playback pattern PP is read out, and is stored in the timing register NP. In addition, the count value of the timer counter TIME is read out, and the sum of the readout value and the pattern length PLP is stored in the timing register ENDT. Furthermore, in step 603, the address pointer Pp for the playback pattern PP is set to be "1" representing the address of the first event data of the pattern PP. Thereafter, the flow advances to step 604.

If "NO" in step 601, i.e., if the count value TIME of the timer counter is smaller than the repetition period ENDT, the flow directly jumps from step 601 to step 604 while skipping processing in steps 602 and 603.

In step 604, the count value TIME of the timer counter is compared with the tone generation timing NP. If the count value TIME is equal to or larger than the tone generation timing value NP, since the tone generation timing has been reached, the flow advances to step 605 to execute tone generation processing, and tone generation timing update processing. In step 605, events from an event indicated by the pointer Pp up to an event immediately before the next interval data are read out, and tone generation operations based on these events are instructed to the sound source 27. In step 606, the address pointer Pp for reading out the playback pattern Pp is set to be the address of the next interval data. In step 607, interval data D(PPA,Pp) written at the address Pp is read out, and is added to data in the timing register NP. In step 608, the pointer Pp is incremented. Thereafter, the flow returns to the previous processing (step 202 in FIG. 2).

If "NO" in step 604, i.e., if the count value TIME of the timer counter is smaller than the tone generation timing value NP, the flow directly returns to the previous processing (step 202 in FIG. 2) without executing the processing in steps 605 to 608.

Figure 7:
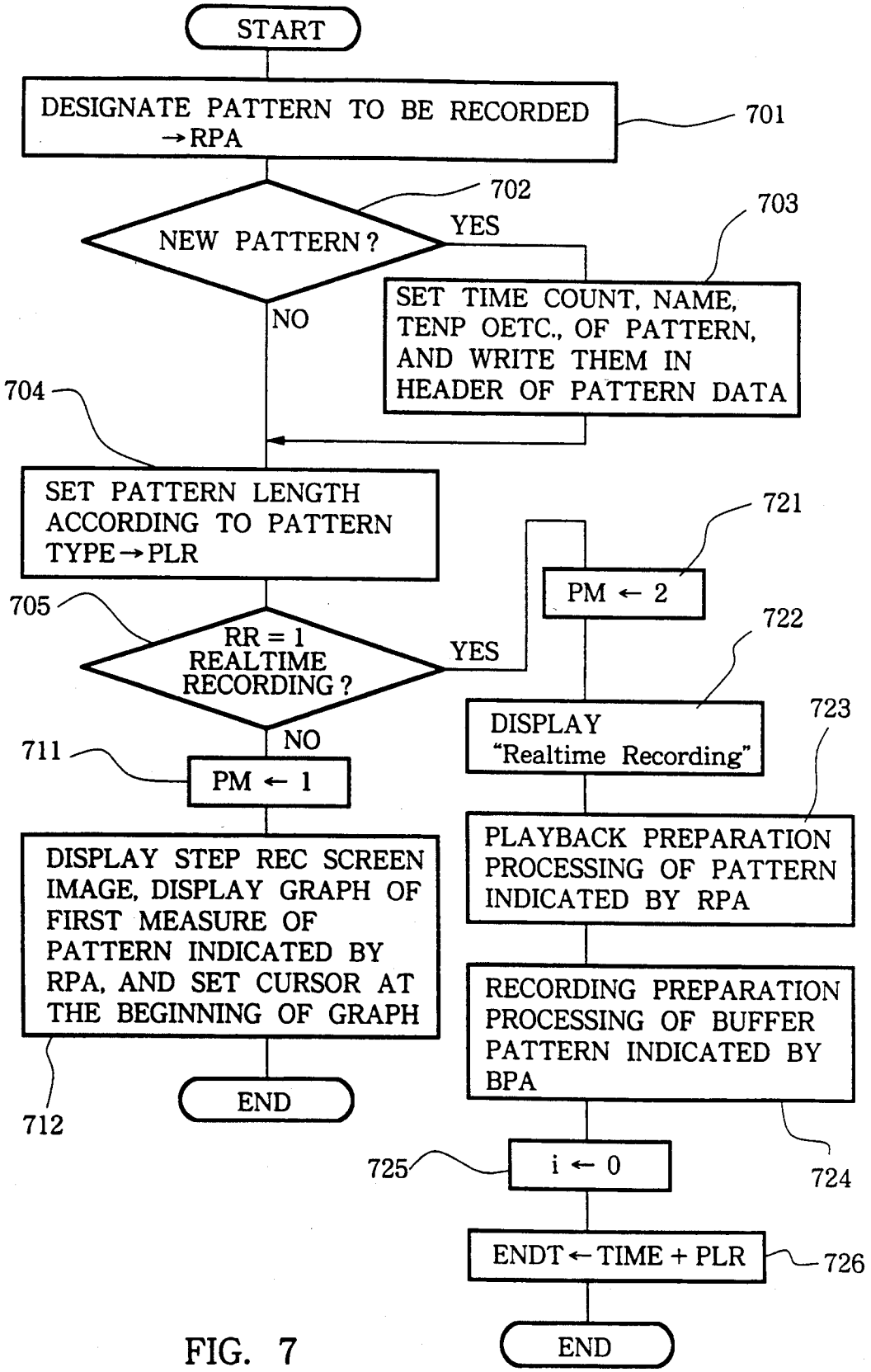

In the rhythm performance apparatus shown in FIG. 1, when the recording (REC) switch of the panel switches 23 is turned on in the playback mode (PM=0), the CPU 11 detects this ON event upon execution of the panel SW processing 0 (step 205), and executes recording SW ON event processing shown in FIG. 7.

Referring to FIG. 7, in step 701, a number of a pattern to be recorded is read, and its start address is stored in a register RPA. The number of the pattern to be recorded is instructed using the ten-key pad or selection switch of the panel switches 23. In step 702, it is checked if a pattern to be recorded is a new pattern. If YES in step 702, time count data, name data (rhythm name and type), tempo data, and the like of a pattern inputted by the panel switches 23 are read out, and are written in a header area of pattern data RP. Thereafter, the flow advances to step 704. On the other hand, if NO in step 702, the flow directly jumps from step 701 to step 704 while skipping step 703.

In step 704, a pattern length is set according to the pattern type, and in step 705, a realtime recording mode flag RR is checked. If the flag RR is "0", the flow advances to step 711; if it is "1", the flow advances to step 721.

From step 711, step recording processing is executed. More specifically, in step 711, the processing mode PM is set to be "1" (step recording mode). In step 712, a step recording screen image shown in FIG. 23 is displayed on the display 25. The graph 37 of the first measure of the pattern indicated by the start address RPA is displayed, and the cursor 39 is located at the beginning of the graph. Thereafter, the flow returns to the previous processing (step 207 in FIG. 2).

From step 721, realtime recording processing is executed. More specifically, in step 721, the processing mode PM is set to be "2" (realtime recording mode), and in step 722, the display 25 is caused to display "Realtime Recording". In step 723, playback preparation processing of a pattern indicated by the start address RPA is executed, and in step 724, recording preparation processing of a buffer pattern indicated by the start address BPA is executed. In step 725, a variable i is cleared. In step 726, the count value of the timer counter TIME is read out, and the sum of the readout value and the pattern length PLR is stored in the repetition timing register ENDT. Thereafter, the flow returns to the previous processing (step 207 in FIG. 2).

Figure 8:
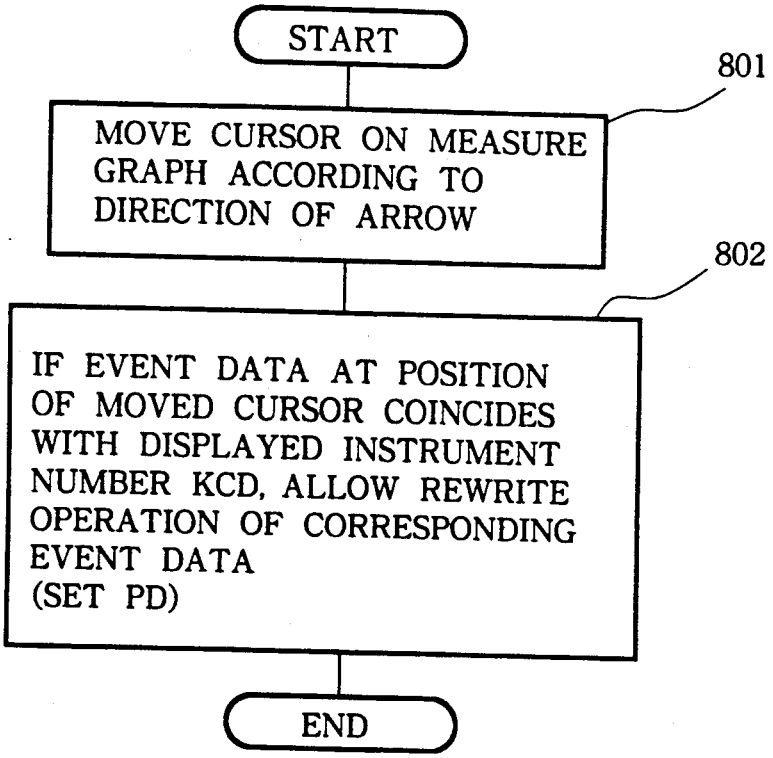

When one of the arrow (right and left) switches for moving a time of the panel switches 23 is turned on in the step recording mode (PM=1), the CPU 11 detects this ON event upon execution of the panel SW processing 1 in step 207 in FIG. 2, and executes arrow SW ON event processing shown in FIG. 8.

Referring to FIG. 8, in step 801, the cursor 39 on the measure graph 37 is moved according to the direction of the arrow. In step 802, if event data at the position indicated by the moved cursor coincides with a displayed instrument number KCD, the address pointer Pd is set at a data write position at the timing indicated by the cursor 39, and a rewrite operation of the corresponding event data is allowed. In the display screen image, a rhombic mark 41 on the measure graph 37 indicates that event data is written at the timing, and a short line dividing the measuring graph 37 indicates a time count. The measure graph 37 is scrolled to the right or left when the cursor 39 is moved to the right or left beyond the displayed graph. After the processing in step 802 is executed, the flow returns to the previous processing (step 207 in FIG. 2).

Figure 9:
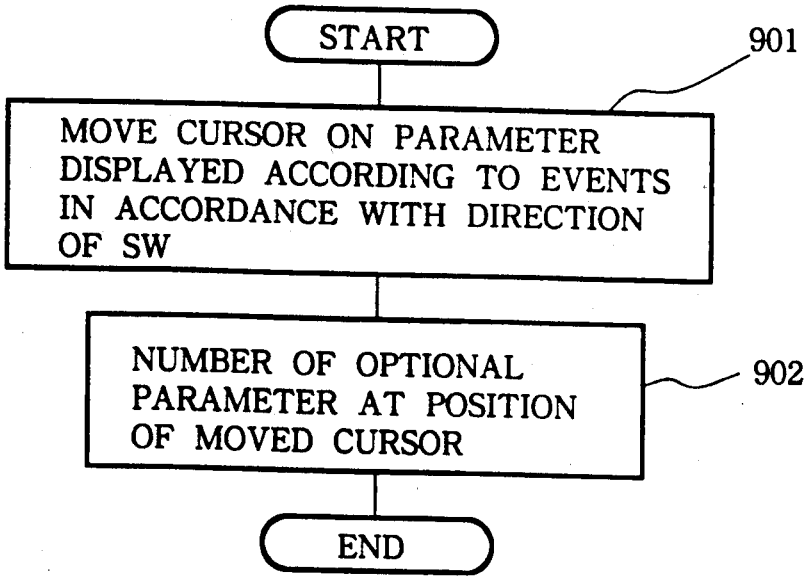

When one of the cursor key (upward, downward, right, and left cursor keys) switches of the panel switches 23 is turned on in the step recording mode (PM=1), the CPU 11 detects this ON event upon execution of the panel SW processing 1 in step 207 in FIG. 2, and executes cursor SW ON event processing shown in FIG. 9.

Referring to FIG. 9, in step 901, a cursor 35 which is movable on parameters displayed according to event data is moved according to the direction of the ON cursor SW. In step 902, a number of an optional parameter at a position indicated by the moved cursor is set as a variable x. After the processing in step 902 is executed, the flow returns to the previous processing (step 207 in FIG. 2).

Figure 10:
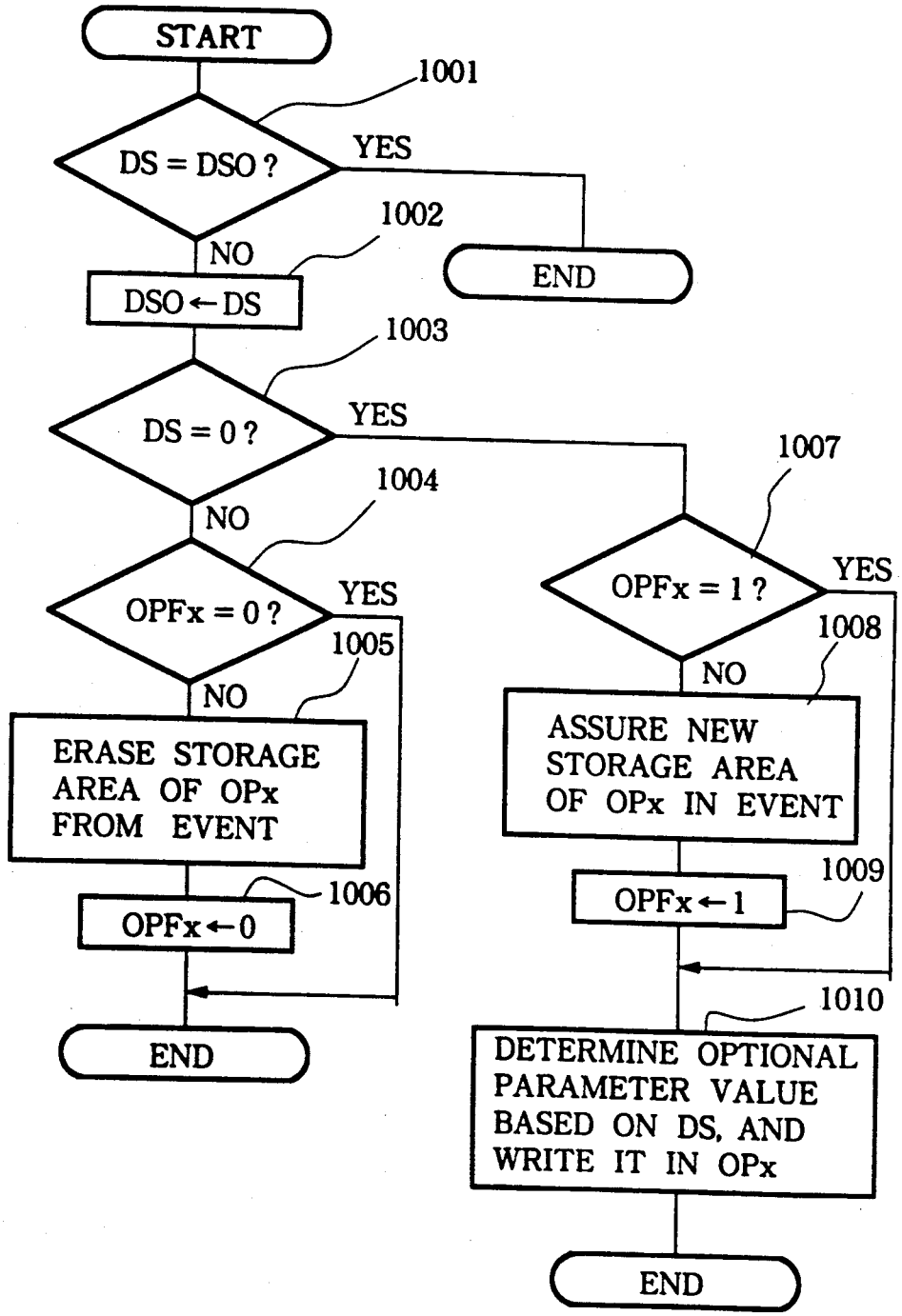

In the rhythm performance apparatus shown in FIG. 1, the CPU 11 executes a data slider processing routine shown in FIG. 10 every time it executes the panel SW processing 1 in step 207 in FIG. 2.

Referring to FIG. 10, in step 1001, a position DS of the data slider is checked, and compared with a previous data slider position DSO. If DS=DSO, i.e., if the data slider is fixed in position, the data slider processing routine is ended, and the flow returns to the previous processing (step 207 in FIG. 2).

On the other hand, if the data slider is moved, the flow advances to step 1002, and the previous slider position DSO is updated to the current slider position DS. In step 1003, it is checked if the slider position DS is 0. If YES in step 1003, the optional parameter flag OPFx is checked in step 1004. If the flag OPFx is "1", the storage area of the optional parameter OPx is erased from the corresponding event in step 1005, and the flag OPFx is cleared in step 1006. Thereafter, the flow returns to the previous routine (step 207 in FIG. 2). On the other hand, if the flag OPFx is "0", the data slider processing routine is ended, and the flow directly returns from step 1004 to the previous routine while skipping steps 1005 and 1006.

On the other hand, if it is determined in step 1003 that the slider position DS is not 0, the optional parameter flag OPFx is checked in step 1007. If the flag OPFx is "0", the storage area of the optional parameter OPx is assured in the event data in step 1008, and the flag OPFx is set in step 1009. Thereafter, the flow advances to step 1010. On the other hand, if the flag OPFx is "1", the flow directly jumps from step 1007 to step 1010 while skipping steps 1008 and 1009. In step 1010, the optional parameter value OPx is determined on the basis of the data slider position DS, and is written in the storage area assured in step 1008, or the storage area where the original parameter OPx is written. After the processing in step 1010 is executed, the data slider processing routine is ended, and the flow returns to the previous routine (step 207 in FIG. 2).

Figure 11:
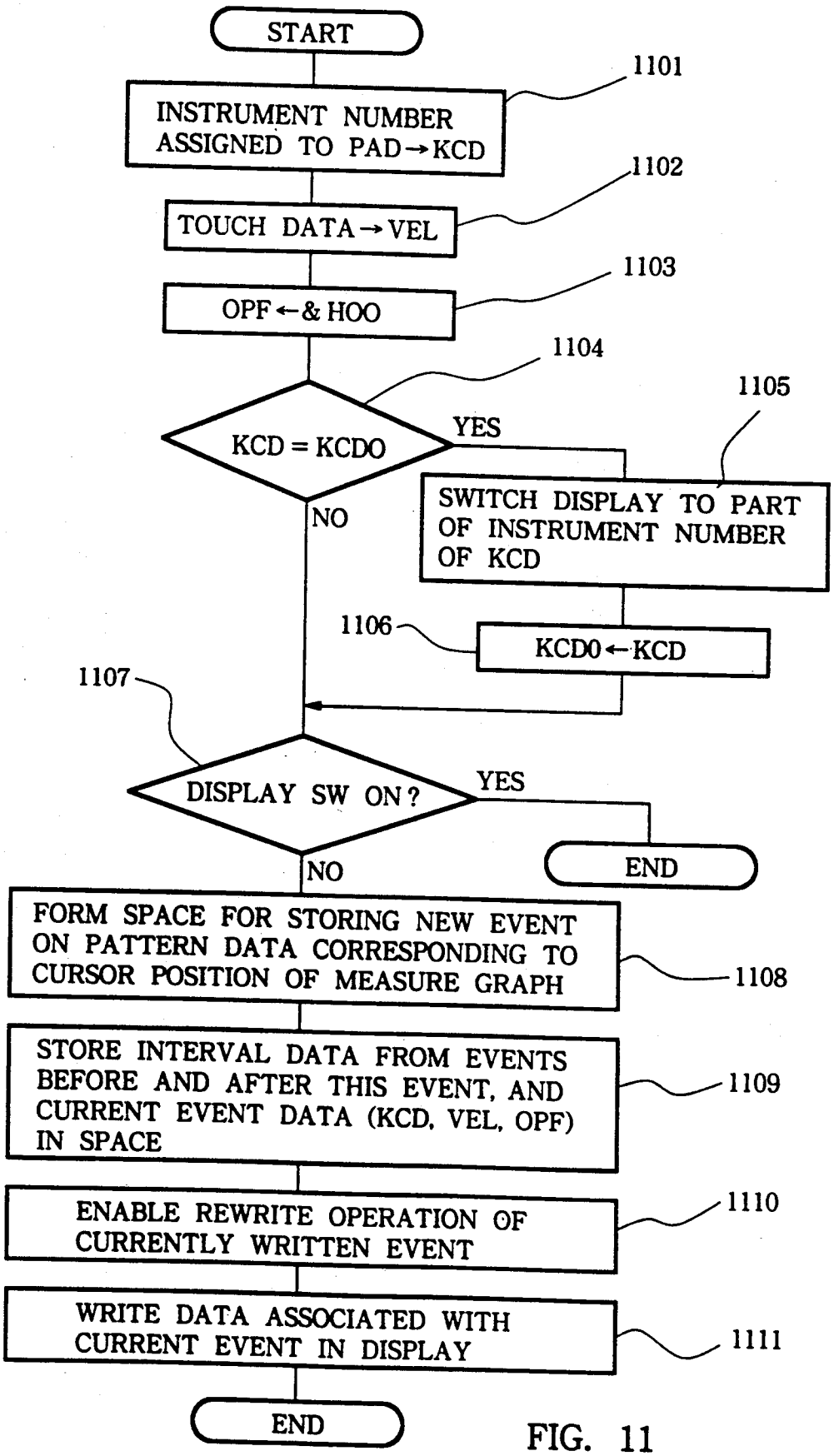

When the drum pad 19 is operated in the step recording mode (PM=1), the CPU 11 detects this ON event upon execution of the pad processing 1 in step 206 in FIG. 2, and executes pad ON event processing shown in FIG. 11.

Referring to FIG. 11, in step 1101, an instrument number assigned to the operated pad is read, and is written in the register KCD. Furthermore, in step 1102, touch data of the pad is read, and is written in the register VEL, and 8 bits of the optional parameter flag OPF are set to be all "0"s (&H00). Thereafter, in step 1104, a previous instrument number KCDO and the current instrument number KCD are compared. If KCD ≠ KCDO, i.e., if the instrument numbers are different, a display is switched to a part of the instrument number KCD in step 1105. In step 1106, the previous instrument number KCDO is updated to the current instrument number KCD. Thereafter, the flow advances to step 1107. On the other hand, if the instrument numbers are equal to each other (KCD=KCDO), the flow directly jumps from step 1104 to step 1107. It is checked in step 1107 if a display SW is ON. If YES in step 1107, the pad ON event processing is ended, and the flow returns to the previous routine (step 206 in FIG. 2). More specifically, in this embodiment, when the display switch is simultaneously turned on, an instrument type can be switched without writing an event.

On the other hand, if "NO" in step 1107, i.e., if the display SW is not ON, the flow advances to step 1108. In step 1108, a space for storing a new event is formed on pattern data corresponding to the cursor position of the measure graph 37. Furthermore, in step 1109, interval data from events before and after this event, and current event data (instrument number KCD, velocity data VEL, optional parameter OP, and the like) are written in the formed space. In step 1110, a rewrite operation of the currently written event is allowed. In step 1111, data associated with the current event are written in a displayed image. Thereafter, the pad ON event routine is ended, and the flow returns to the previous routine (step 206 in FIG. 2).

More specifically, in the step recording mode, a tone generation timing is designated by the cursor 39 on a screen image shown in FIG. 23 displayed on the display 25, and the drum pad 19 is operated while the display SW is OFF, so that a rhythm tone (instrument type KCD) to be generated at the tone generation timing can be written. After the write operation, the tone generation timing is indicated by the rhombic mark 41 on the measure graph 37, and the instrument type KCD is displayed as "(HH1)" in parentheses beside the letters of "STEP REC" representing the step recording mode. In addition, the corresponding optional parameters are displayed. When a rhythm tone to be generated has already been written at the position (tone generation timing) of the cursor 39, optional parameters of an instrument type KCD coinciding with a display is displayed. The display of the instrument type KCD can be switched by operating the drum pad 19 while the display SW is turned on.

Of the displayed optional parameters, a parameter indicated by the cursor 35 can be written, rewritten, or erased upon operation of the data slider. More specifically, when the data slider is moved from a given position to another position other than "0", the optional parameter indicated by the cursor 35 can be written or rewritten (overwritten). When the slider is moved from a position other than "0" to the position "0", the corresponding parameter can be erased.

Figure 12:
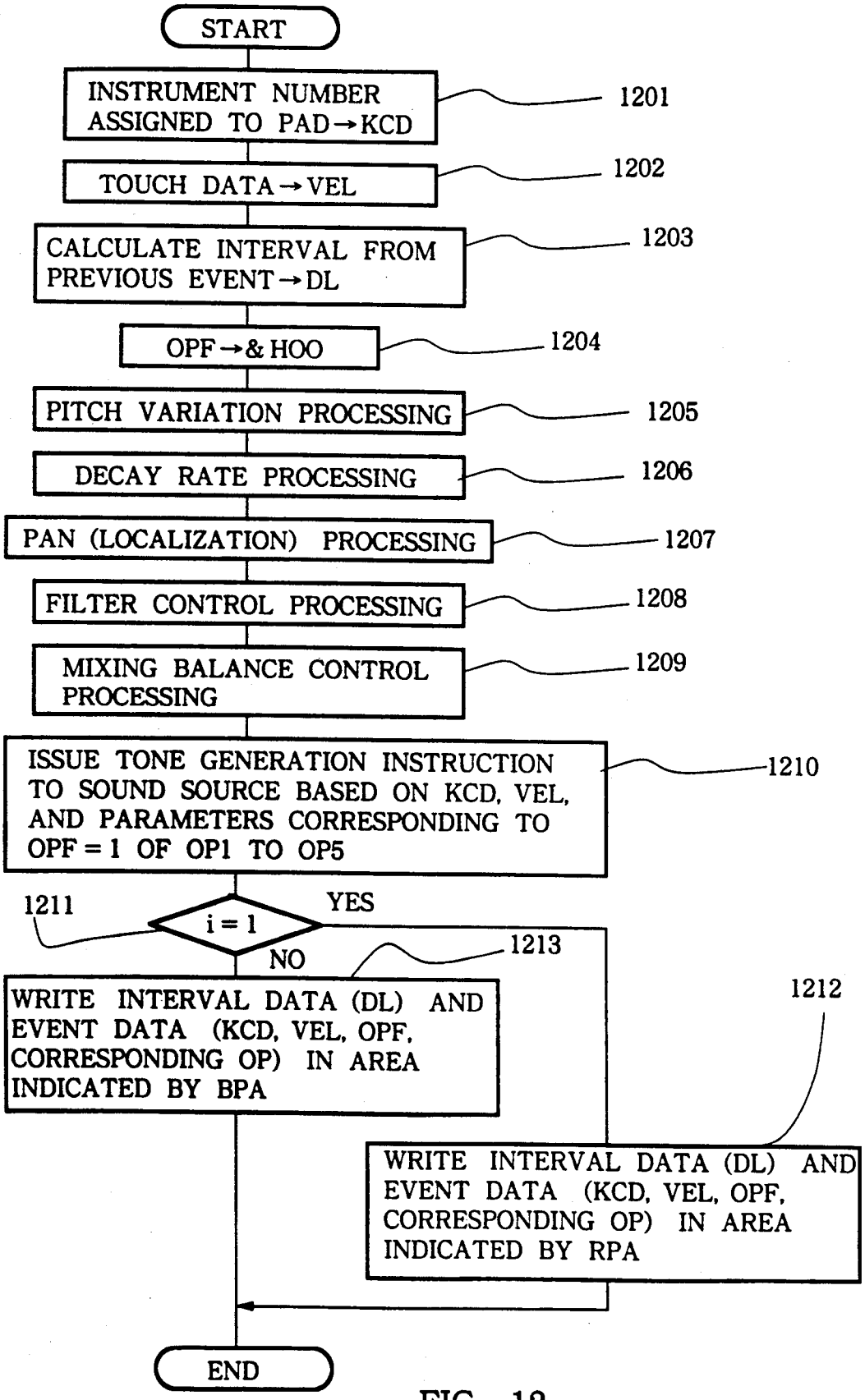

In the rhythm performance apparatus shown in FIG. 1, when the drum pad 19 is operated in the realtime recording mode (PM=1), the CPU 11 detects this ON event upon execution of the pad processing 2 in step 209 in FIG. 2, and executes pad ON event processing shown in FIG. 12.

Referring to FIG. 12, in step 1201, an instrument number assigned to the operated pad is read, and is written in the register KCD. In step 1202, touch data of the pad is read, and is written in the register VEL. In step 1203, an interval DL from the previous event is calculated, and is written in an interval register DL. In step 1204, 8 bits of the optional parameter flag OPF are set to be all "0"s (&H00). Subsequently, pitch variation processing in step 1205, decay rate processing in step 1206, pan (localization) processing in step 1207, filter control processing in step 1208, and mixing balance control processing in step 1209 are executed. In step 1210, a tone generation instruction is issued to the sound source 27 on the basis of the instrument number KCD, velocity data VEL, and parameters OP corresponding to "1" flags OPF of the optional parameters OP1 to OP5. In step 1211, it is checked if the variable i is "1". If YES in step 1211, the interval data DL, the event data KCD and VEL, the flags OPF, and the parameters OP corresponding to the flags OPF are written in an area indicated by the start address RPA in step 1212, and thereafter, the pad ON event routine is ended. On the other hand, if NO in step 1211, the data DL, KCD, VEL, OPF, and OP are written in an area indicated by the start address BPA in step 1213, and thereafter, the pad ON event routine is ended. Thus, the flow returns to the previous routine (step 206 in FIG. 2).

Figure 13:
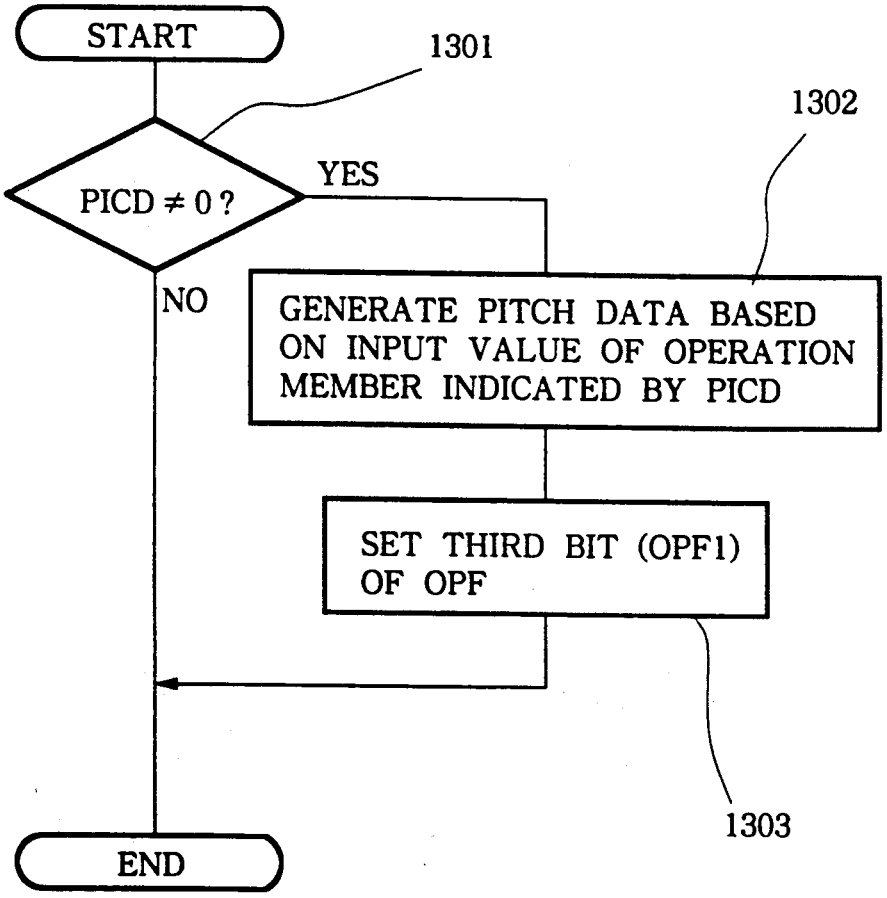

The pitch variation processing, the delay rate processing, the pan processing, the filter control processing, and the mixing balance control processing can be realized by a known method. FIG. 13 shows an example of the pitch variation processing in step 1205 in FIG. 12.

Referring to FIG. 13, in step 1301, pitch control device data PICD of the optional parameter control device table (see FIG. 22) is checked. If the data PICD is 0, since no pitch control device is set, the pitch variation processing is ended, and the flow returns to the previous processing (step 1206 in FIG. 12). On the other hand, if the data PICD is not 0, pitch data is formed on the basis of an input value of an operation member (pitch control device) represented by the data PICD, and is stored in the optional parameter processing buffer OPiB in step 1302. In step 1303, the third bit OPF3 of the optional parameter is set. Thereafter, the pitch variation processing is ended, and the flow returns to the previous processing (step 1206 in FIG. 12).

The delay rate processing, the pan processing, the filter control processing, and the mixing balance control processing can be performed in the same manner as the pitch variation processing.

Figure 14:
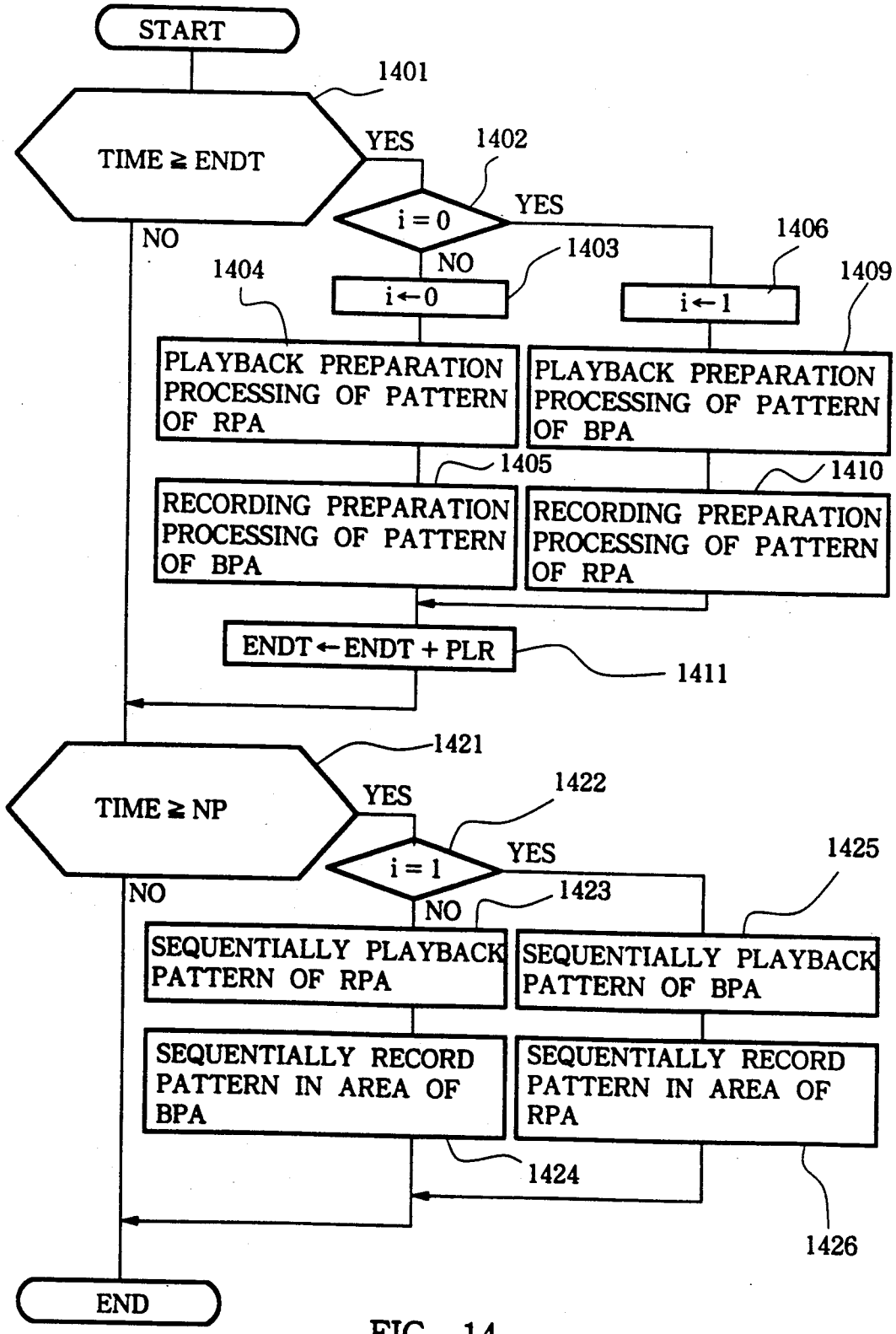

FIG. 14 shows in detail the pattern playback/recording processing executed in step 210 in FIG. 2 in the realtime recording mode (PM=2).

Referring to FIG. 14, in step 1401, the count value TIME of the timer counter is compared with the repetition period ENDT (see step 726 in FIG. 7), and in step 1421, the count value TIME of the timer counter is compared with the tone generation timing NP.

If the count value TIME is smaller than the period ENDT and (step 1401), and if the count value TIME is smaller than the tone generation timing value NP or (step 421), the flow returns to the previous processing (step 202 in FIG. 2) without executing processing.

If "YES" in step 1421, i.e., if the count value TIME of the timer counter is equal to or larger than the tone generation timing value NP, the tone generation timing is detected. In this case, the flow advances to step 1422 to check the variable i. If the variable i is 0, the pattern RP indicated by the start address RPA is sequentially played back in step 1423, and the playback pattern is sequentially recorded in the pattern area BP indicated by the start address BPA in step 1424. Thereafter, the pattern playback/recording processing is ended, and the flow returns to the previous processing (step 202 in FIG. 2). On the other hand, if the variable i is 1, the pattern BP indicated by the start address BPA is sequentially played back in step 1425, and the playback pattern is sequentially recorded in a pattern area RP indicated by the start address RPA in step 1426. Thereafter, the pattern playback/recording processing is ended, and the flow returns to the previous processing (step 202 in FIG. 2).

If "YES" in step 1401, i.e., if the count value TIME of the timer counter is equal to or larger than the repetition period ENDT, processing of a series of rhythm patterns consisting of one or two measures is completed. In this case, the flow advances to step 1402 to repeat recording and playback operations while replacing the roles of the patterns RP and BP. In step 1402, the variable i is checked. If the variable i is 1, the variable i is changed to 0 in step 1403. In step 1404, playback preparation processing of the pattern RP indicated by the start address RPA is executed. In step 1405, recording preparation processing of the pattern area BP indicated by the start address BPA is executed. Thereafter, the flow advances to step 1411. On the other hand, if the variable i is 0, the variable i is changed to 1 in step 1406. In step 1407, playback preparation processing of the pattern BP indicated by the start address BPA is executed. In step 1408, recording preparation processing of the pattern area RP indicated by the start address RPA is executed. Thereafter, the flow advances to step 1411. In step 1411, the count value of the repetition timing register ENDT is read out, and the sum of the readout value and the pattern length PLR is stored in the repetition timing register ENDT. The flow then advances to step 1421. With the role switching processing in steps 1402 to 1411, the pattern RP is played back, the playback pattern data is synthesized with a pattern of a rhythm performance made at that time, and the synthesized pattern data are recorded in the pattern area BP in real time. When the playback and recording operations corresponding to the pattern length PLR are ended, the pattern BP is then played back, and is recorded in the pattern area RP. Thereafter, every time the playback and recording operations corresponding to the pattern length PLR are ended, the playback and recording operations are repeated while replacing the patterns RP and BP.

Figure 15:
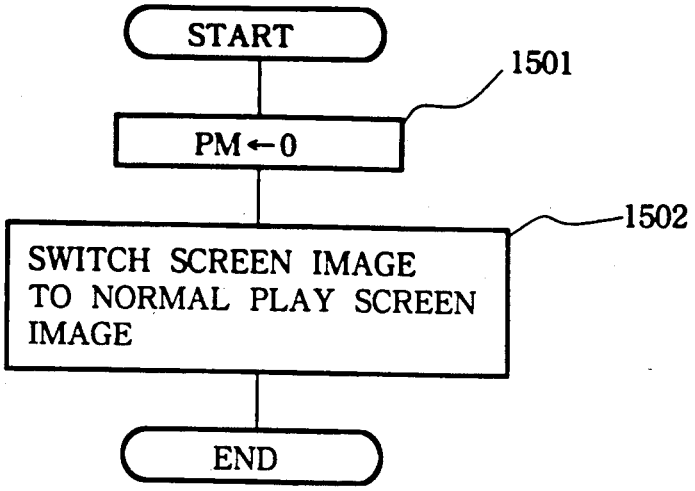

In the rhythm performance apparatus shown in FIG. 1, when the stop (STOP) switch in the panel switch 23 is turned on in the step recording mode (PM=1) or the pattern playback mode (PM=3), the CPU 11 executes this ON event upon execution of the panel SW processing 1 (step 207) or the panel SW processing 3 (step 212) shown in FIG. 2, and executes a stop SW ON event (I) routine shown in FIG. 15.

Referring to FIG. 15, in step 1501, the mode register PM is set to be "0" (normal mode), and in step 1502, a display image of the display 25 is switched to a normal play screen image shown in FIG. 24. Thereafter, the stop SW ON event routine is ended, and the flow returns to the previous processing (step 202 in FIG. 2).

Figure 16:
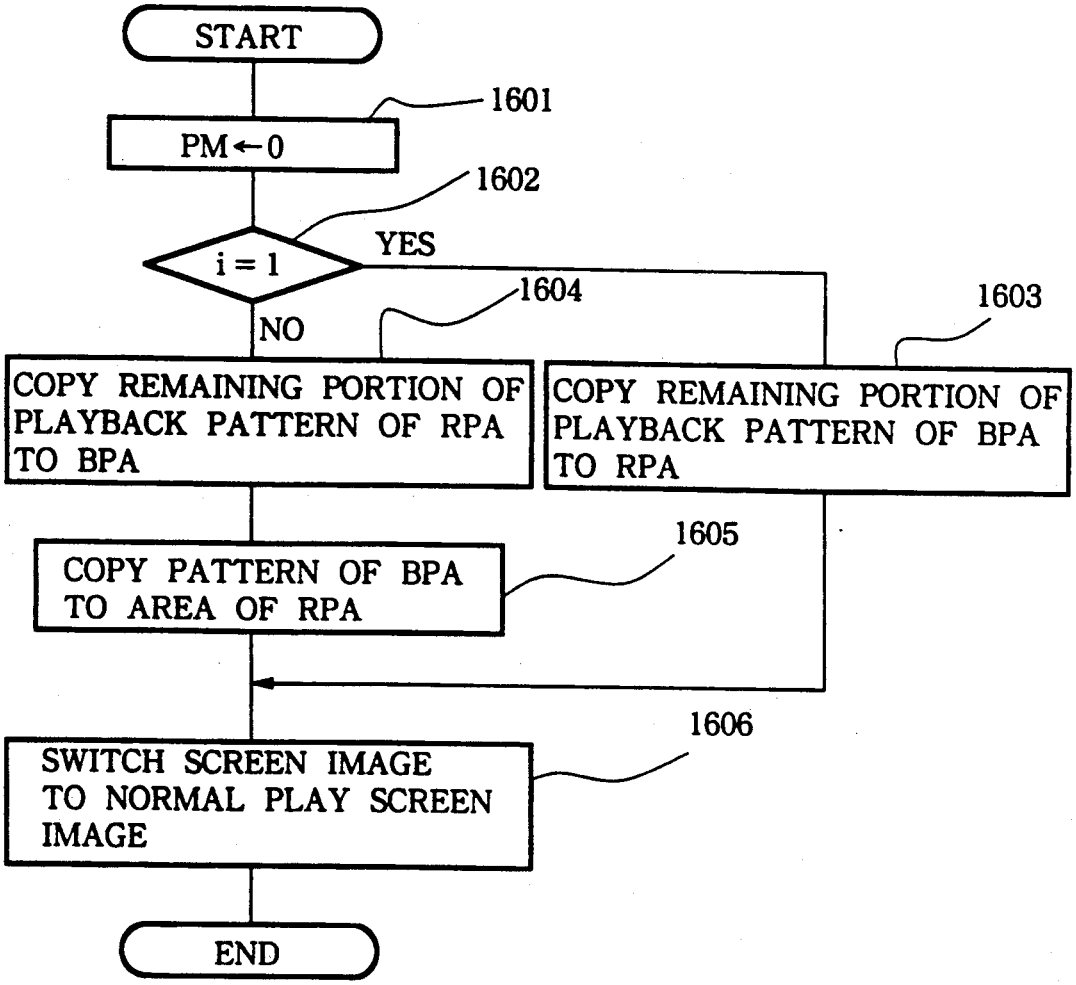

In the rhythm performance apparatus shown in FIG. 1, when the stop (STOP) switch in the panel switch 23 is turned on in the realtime recording mode (PM=2), the CPU 11 detects this ON event upon execution of the panel SW processing 2 in step 209 in FIG. 2, and executes stop SW ON event (II) routine shown in FIG. 16.

Referring to FIG. 16, in step 1601, the mode register PM is set to be "0" (normal mode), and in step 1602, the variable i is checked. If the variable i is 1, the remaining portion of the playback pattern BP is copied to the pattern area RP in step 1603, and thereafter, the flow advances to step 1606. On the other hand, if the variable i is 0, the remaining portion of the playback pattern RP is copied to the pattern area BP in step 1604, and the pattern BP is copied to (overwritten on) the pattern area RP in step 1605. Thereafter, the flow advances to step 1606.

In step 1606, a display image of the display 25 is switched to a normal play screen image, and thereafter, the stop SW ON event routine (II) is ended. The flow then returns to the previous processing (step 202 in FIG. 2).

What is claimed is:

1. A rhythm performance apparatus comprising:

a first storage means for storing a first rhythm pattern data comprising (1) event data which include tone generation instructing data and tone generation supplemental data representing characteristics of a musical tone to be generated and (2) timing data which represent the generating timing of the event data;

a second storage means for storing a second rhythm pattern data comprising event data which include at least tone generation instructing data and timing data; and a transfer means for transferring the tone generation supplemental data stored in the first storage means to the second storage means as supplemental data corresponding to the tone generation instructing data stored in the second storage means.

2. An apparatus according to claim 1, wherein said tone generation instructing data include musical instrument tone type data.

3. An apparatus according to claim 1, wherein said supplemental data include at least one kind of data selected from touch data, panning data, pitch data, decay data, filter data and mixing ratio data.

4. An apparatus according to claim 1, wherein said transfer means transfers the supplemental data in the first rhythm pattern, at a timing at which one of event timings in the first rhythm pattern data and one of those in the second rhythm pattern data coincide or substantially coincide with each other, as supplemental data in the second rhythm pattern corresponding to said timing.

5. An apparatus according to claim 2, which further comprises a first designation means for designating musical instrument tone type for each of the first and second rhythm patterns, and wherein said transfer means transfers the tone generation supplemental data corresponding to the musical instrument tone type designated in the first rhythm pattern as tone generation supplemental data corresponding to the musical instrument tone type designated in the second rhythm pattern.

6. An apparatus according to claim 3, which further comprises a second designation means for designating one kind of said tone generation supplemental data, and wherein said transfer means transfers the tone generation supplemental data in the first rhythm pattern designated by the second designation means as tone generation supplemental data in the second rhythm pattern.

7. An apparatus according to claim 4, wherein each of said timing data represents a generation interval of said event and said transfer means compares accumulation value of the timing data of the first rhythm pattern with that of the timing data of the second rhythm pattern and transfers the supplemental data when the accumulation values coincide or substantially coincide with each other.

8. An apparatus according to claim 1, wherein the presence or absence of said tone generation supplemental data can be set every event.

* * * * *